US007219458B2

(12) United States Patent
Burlando

(10) Patent No.: US 7,219,458 B2
(45) Date of Patent: May 22, 2007

(54) UTILITY POLE WARNING SIGN AND METHOD OF MANUFACTURING THE SAME

(76) Inventor: Albert A. Burlando, 234 Emmans Rd., Flanders, NJ (US) 07836

( * ) Notice: Subject to any disclaimer, the term of this patent is extended or adjusted under 35 U.S.C. 154(b) by 297 days.

(21) Appl. No.: 11/037,874

(22) Filed: Jan. 18, 2005

(65) Prior Publication Data

US 2006/0156599 A1 Jul. 20, 2006

(51) Int. Cl.
*G09F 15/00* (2006.01)

(52) U.S. Cl. ..... 40/607.12; 40/611.08; 40/607.14; 40/666; 248/218.4; 248/227.3; 248/228.7

(58) Field of Classification Search ..... 40/316, 40/584, 607.12, 611.08, 611.11, 607.14, 612, 40/666; 248/218.4, 557.3, 228.7, 230.7, 248/231.81; 104/200
See application file for complete search history.

(56) References Cited

U.S. PATENT DOCUMENTS

| | | | | | |
|---|---|---|---|---|---|
| 2,631,809 | A | * | 3/1953 | Jacobson | 248/317 |
| 4,378,648 | A | * | 4/1983 | Loof et al. | 40/316 |
| 4,821,988 | A | * | 4/1989 | Jimenez | 248/227.3 |
| 4,876,810 | A | * | 10/1989 | Piana et al. | 40/316 |
| 4,899,474 | A | * | 2/1990 | Piana et al. | 40/316 |
| 5,400,992 | A | * | 3/1995 | Pohl | 248/231.81 |

* cited by examiner

*Primary Examiner*—Gary C. Hoge
(74) *Attorney, Agent, or Firm*—Day Pitney LLP

(57) ABSTRACT

A warning sign for mounting on a structural member, such as a cross arm of a utility pole, has an elongated U-shaped support member and a warning message disposed thereon. The warning sign is installed on the structural member by a utility worker at ground level by pushing it upward onto the structural member, about which it locks and cannot be easily removed. The support member and warning message are preferably extruded from high-density polyethylene which includes ultraviolet (UV) inhibitors.

12 Claims, 5 Drawing Sheets

UTILITY POLE WARNING SIGN AND METHOD OF MANUFACTURING THE SAME

BACKGROUND OF THE INVENTION

1. Field of the Invention

The present invention relates to warning signs. More particularly, the present invention relates to warning signs of the variety required in some jurisdictions to be placed on the cross arms of all utility poles mounted immediately adjacent to electrical power lines. Regulatory requirements dictate that the term "High Voltage" be affixed to both sides of the cross arms in order to warn utility workers and the general public of the danger of high voltage.

2. Description of the Prior Art

At present, the signs used for the above-noted purpose are typically flat metal or plastic signs bearing the terminology "High Voltage". The signs are attached to both sides of the cross arm either in the maintenance yard when the pole is being assembled or on-site when the pole is being disposed at a desired location. Signs of this type hold up for a time under ambient conditions, but eventually fall off, fall into disrepair or fade due to weather conditions, especially exposure to sunlight, and must be replaced.

Replacement typically requires a lineman to climb the pole or to use a bucket lift truck to reach the level of the cross arm to install a new sign, generally with hammer and nails or some other suitable fastening means. Before this can be done, the lineman must cover all of the live wires and other components within close proximity to the sign with an insulating rubber blanket to protect himself and others from the danger of electrocution. While prudent, this safety procedure takes additional time and adds to the labor costs of the utility.

The present invention enables warning signs of this type to be installed and replaced from ground level without requiring a lineman to ascend to the level of electrically live components, thereby lowering labor costs and reducing the risk of electrocution.

SUMMARY OF THE INVENTION

Accordingly, the present invention is a utility pole warning sign which may be installed by a utility work onto the cross arm of a utility pole from ground level. The warning sign comprises an elongated U-shaped support member which is adapted to fit around a cross arm of a utility pole and remain there more or less permanently, and a warning message on at least one of two sides of the support member.

In brief, the support member, which is extruded, preferably from a high-density polyethylene having ultraviolet (UV) inhibitors, has a base, a first side, a second side and an interior between the first and second sides, all in the manner of a U-shape. The base has a fin extending therefrom in a direction away from the first and second sides. The fin is provided to enable a utility worker to grasp the warning sign with a tool, such as a hot stick, and may have one or more holes extending transversely therethrough to facilitate such manipulation.

The first side and the second side each extend from the base to top ends having a first oblique member and a second oblique member, respectively. The first and second members are inclined toward the interior of the support member, so as to direct the cross arm of a utility pole into the interior of the support member and to separate the first and second sides from one another when the warning sign is pushed upward against the cross arm. The first and second sides each have an inner end which extends inward of the first and second sides, respectively, toward the interior of the support member. When the support member is pushed upward so as to completely cover the cross arm, the inner ends of the first and second oblique members extend over the cross arm and prevent the removal of the warning sign therefrom.

The warning message is disposed on one or both of the first and second sides, where it may be held by an adhesive, rivets, screws or be slidingly received by upper and lower slot members. The warning message is preferably a coextruded sheet having two layers, each of which is of a different color, the warning message having text engraved into one of the two layers to a depth exposing the other of the two layers. Preferably, the warning message is coextruded from high-density polyethylene having ultraviolet (UV) inhibitors, one layer being of a yellow color and the other being of a black color, so that, when the text is engraved, it appears as black letters on a yellow background.

The present invention will now be described in more complete detail with frequent reference being made to the figures identified below.

DETAILED DESCRIPTION OF THE PREFERRED EMBODIMENTS

Figure 1:
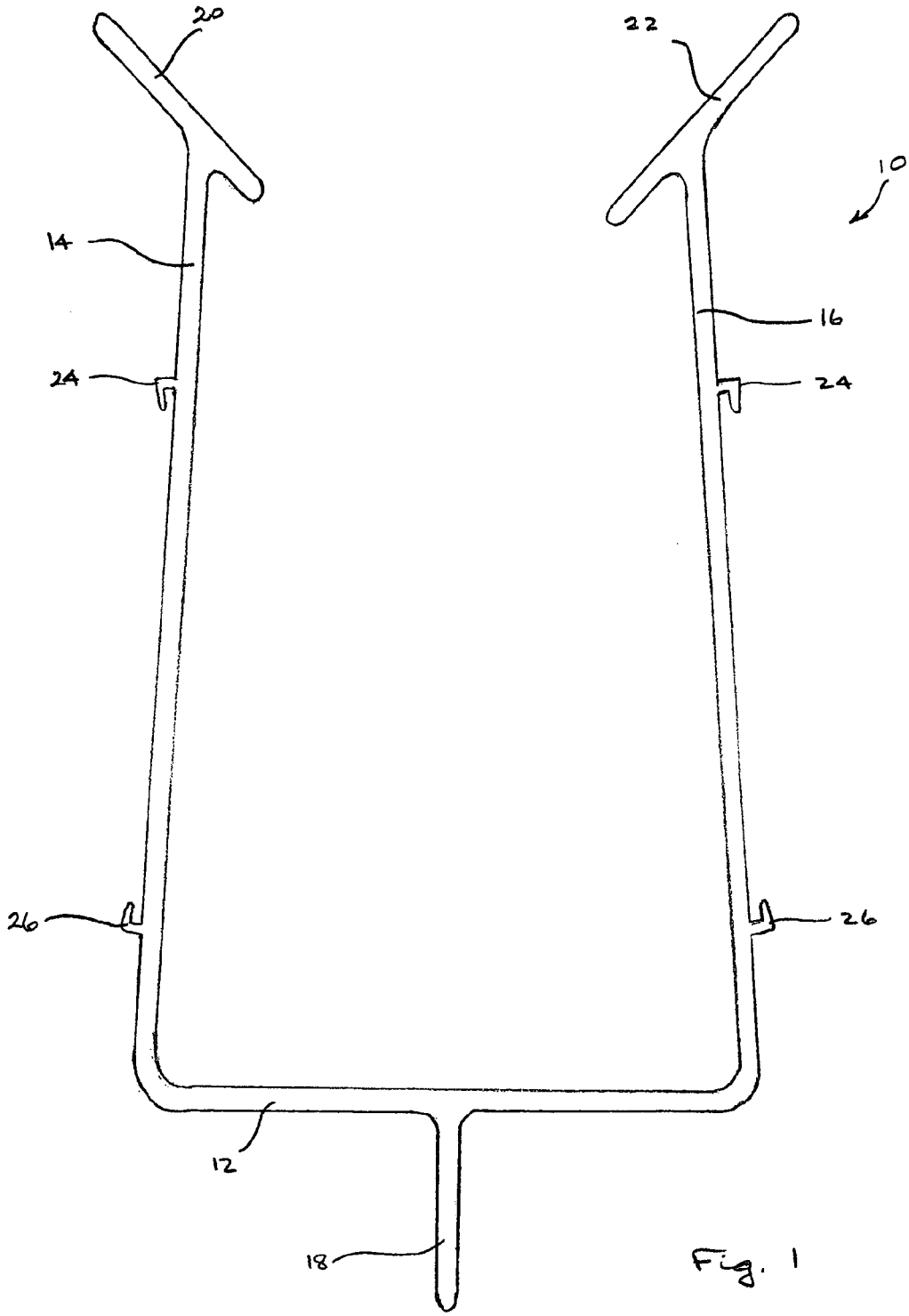
FIG. 1 is a cross-sectional view of the elongated U-shaped support member of the present utility pole warning sign.

Turning now to these figures, FIG. 1 is a cross-sectional view of the elongated U-shaped support member 10. Support member 10 is extruded from a high-density polyethylene, preferably having ultraviolet (UV) inhibitors, in dimensions capable of accommodating a cross arm on a utility pole. The support member 10 has a base 12, a first side 14 and a second side 16. Extending from and below the base 12 is a fin 18 which has one or more holes, not visible in FIG. 1, by which the support member 10 may be held by and manipulated with a hot stick. The latter is a tool commonly used by electrical utility workers, and has an extendable pole with a ratchet-type jaw. The hot stick pole is of a material which does not conduct electricity, enabling a worker using it to perform many tasks on or near electrical cables from a safe distance and without danger of electrical discharge.

The first side 14 and second side 16 of the support member 10 extend upward from the base 12 away from the fin 18 and form the two sides of its U-shape. The first and second sides 14, 16 are inclined somewhat toward one another for reasons to be made clear below. At the top end of each of the first and second sides 14, 16 are oblique members 20, 22. First oblique member 20 is at the top end of first side 14; second oblique member 22 is at the top end of second side 16. Oblique members 20, 22 are inclined toward the interior of the U-shaped support member 10.

On the outside of the first and second sides 14, 16 are upper and lower longitudinal slot members 24, 26 which are designed to slidably accommodate warning messages. Slot members 24, 26 are optional and may be omitted, in which case the warning messages are affixed to the first and second sides 14, 16 in another manner, such as by rivets, screws or an adhesive.

Figure 2:
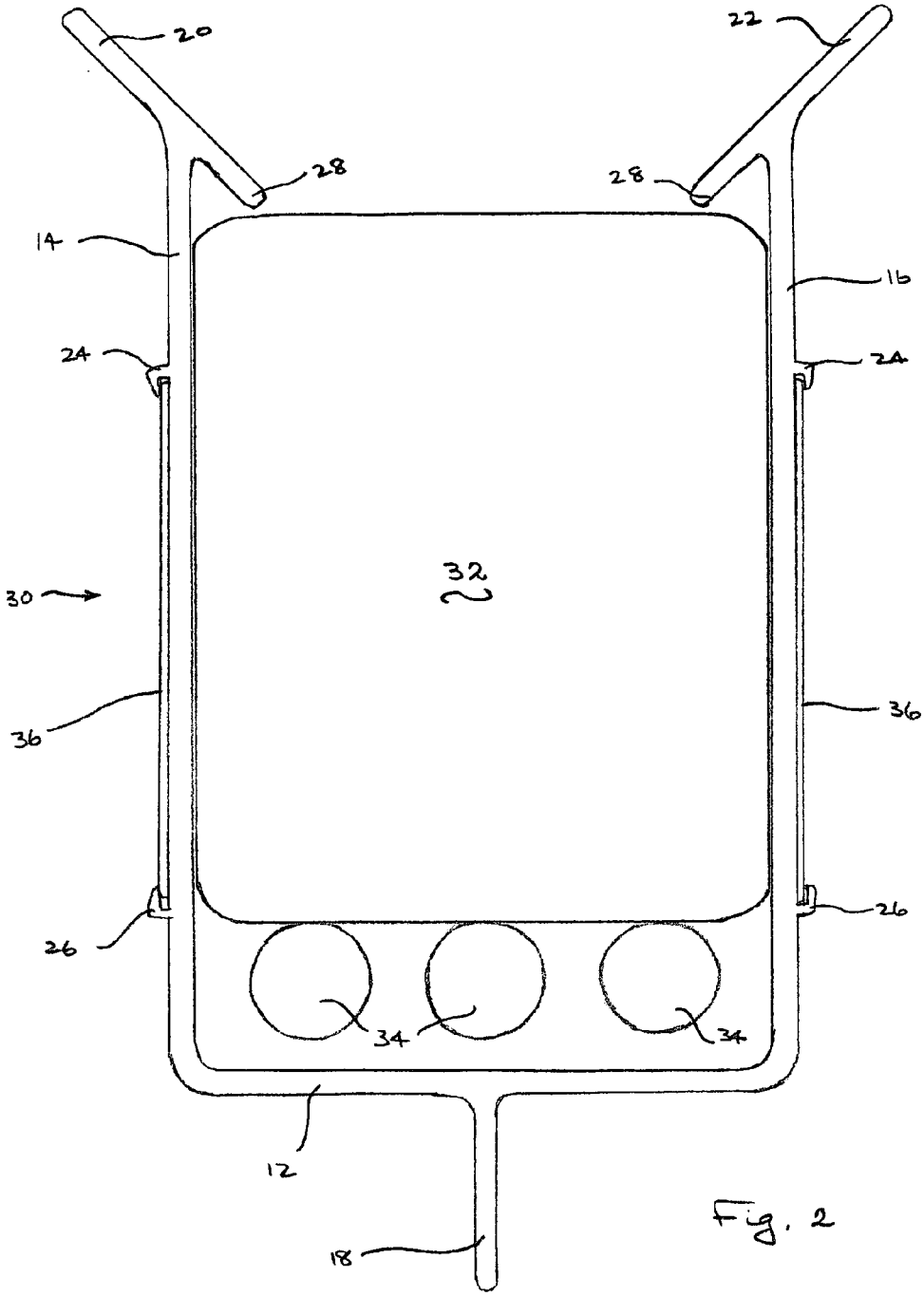
FIG. 2 is a cross-sectional view of the utility pole warning sign disposed on a cross arm.

FIG. 2 is a cross-sectional view of the utility pole warning sign 30 installed on a cross arm 32, also viewed in cross section, of a utility pole. Below the cross arm 32, grounding cables 34, shown in cross section, may be present. Elongated U-shaped support member 10 is provided in dimensions to accommodate any grounding cables 34 along with cross arm 32.

It will be immediately noted that first and second sides 14, 16 are more parallel to one another in FIG. 2 than appears in FIG. 1. As the support member 10 is extruded in the form shown in FIG. 1, first and second sides 14, 16 have a natural tendency to spring back toward their relative positions in FIG. 1 when separated. Therein lies the operation of the support member 10 when installed on a cross arm 32.

When installing utility pole warning sign 30 of the present invention, warning messages 36, preferably of the variety to be described below, are slidably inserted between upper and lower longitudinal slot members 24, 26 on first and second sides 14, 16, or otherwise attached thereto. Then a utility worker grasps the warning sign 30 with a hot stick using fin 18 of support member 10. Raising the warning sign 30 up to the cross arm from below with the hot stick, the utility worker forces oblique members 20, 22 against the bottom of the cross arm 32. Because of their oblique orientation toward the interior of the U-shaped support member 10, this action tends to force the first and second sides 14, 16 apart in a wedge-like fashion so that cross arm 32 slips between the inner ends 28 of the oblique members 20, 22. Warning sign 30 is then forced completely up over cross arm 32 until inner ends 28 reach the top of the cross arm 32, at which point first and second sides 14, 16 snap back toward one another to the positions shown in FIG. 2, leaving inner ends 28 above the cross arm 32. With the oblique members 20, 22 now oriented obliquely downward toward the cross arm 32, the utility pole warning sign 30 cannot be easily removed from the cross arm 32.

Figure 3:
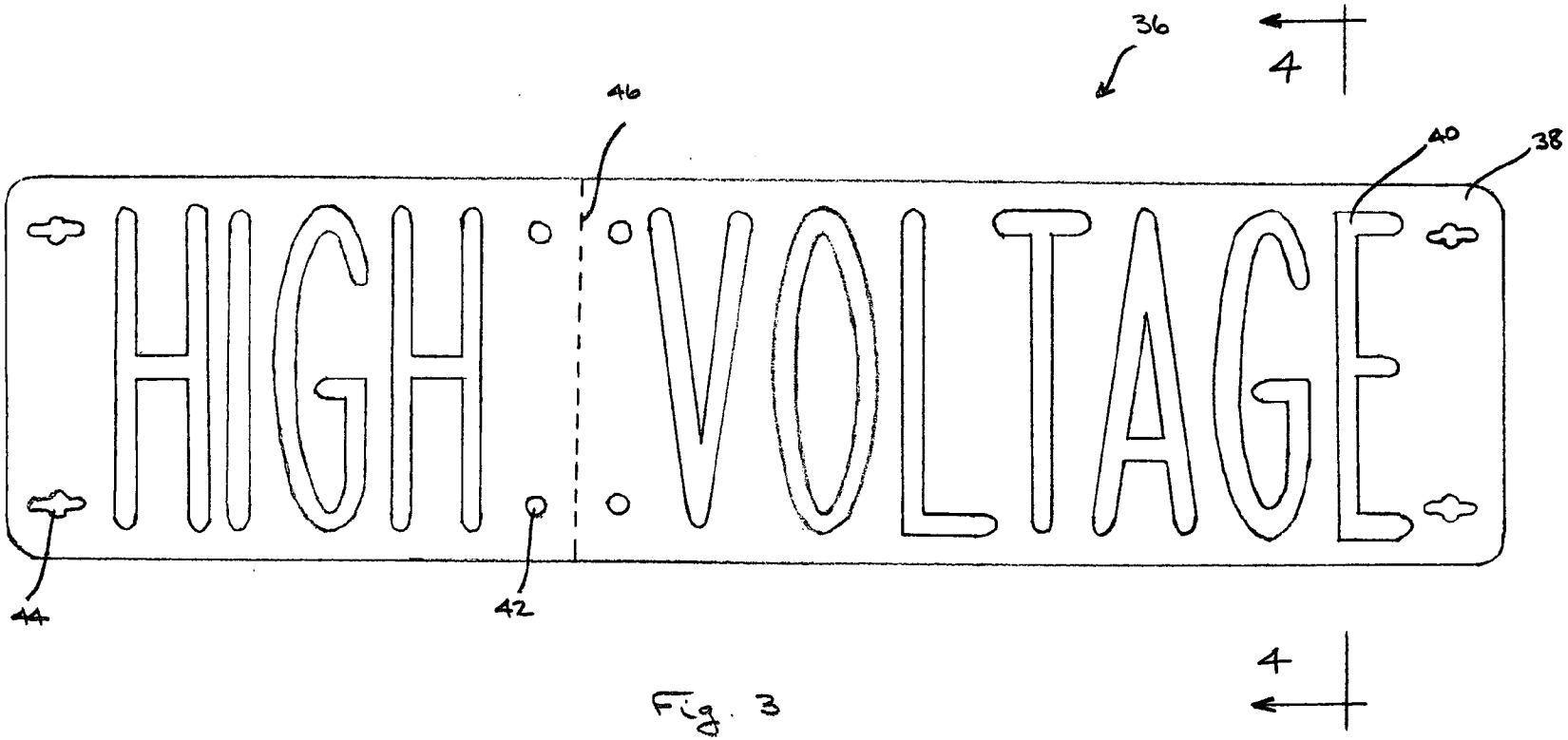
FIG. 3 is a plan view of a warning message which may be mounted on the support member.
Figure 4:
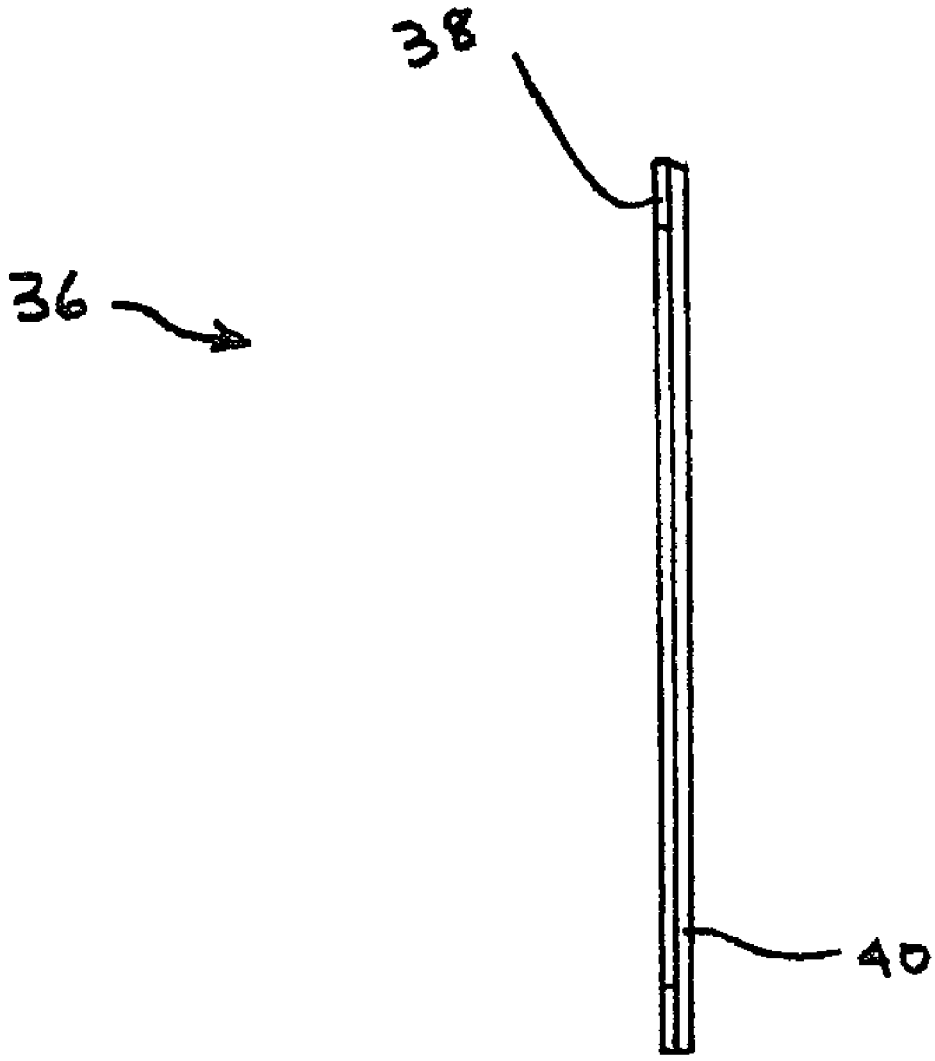
FIG. 4 is a cross-sectional view of the warning message taken as indicated in FIG. 3.

FIG. 3 is a plan view of a warning message 36. FIG. 4 is a cross-sectional view thereof taken as indicated in FIG. 3. Warning message 36 is formed from a coextruded high-density polyethylene sheet, preferably including UV inhibitors. Warning message 36 is extruded in two layers, each of its own color. Top layer 38 is typically of yellow pigmentation and bottom layer 40 is typically of black pigmentation, although other color combinations may be used. After extrusion, the text, such as "HIGH VOLTAGE" as shown in FIG. 3, is engraved into the coextruded sheet by removing discrete portions of the top layer 38 to reveal the bottom layer 40 in the form of letters. That the desired text is provided by engraving a coextruded sheet, not a laminated sheet, to remove a top layer 38 of one color to reveal a bottom layer 40 of another color ensures that the warning message 36 will not peel apart or wear off due to inclement conditions.

It will be noted that warning message 36 includes round holes 42 and slotted holes 44 which may be used to attach warning message 36 to a support member 10 not having slot members 24, 26 with screws or rivets. Slotted holes 44 ensure that the warning message 36 will not buckle when the weather is hot; in other words, the slotted holes 44 allow for the expansion of the warning message.

Warning message 36 may also be perforated or scored along line 46 to permit its ready separation into two smaller parts. This may be useful where a cross arm extends an insufficient distance from a utility pole to mount the warning sign 30. In that event, warning message 36 may be cut into two pieces along line 46 so that one piece could be positioned on the cross arm on one side of the pole and the other piece on the cross arm on the other side of the pole to provide the necessary warning. In such a situation, support member 10 is also cut into two pieces of appropriate length to mount the two pieces of warning message 36 on opposite sides of the pole.

Figure 5:
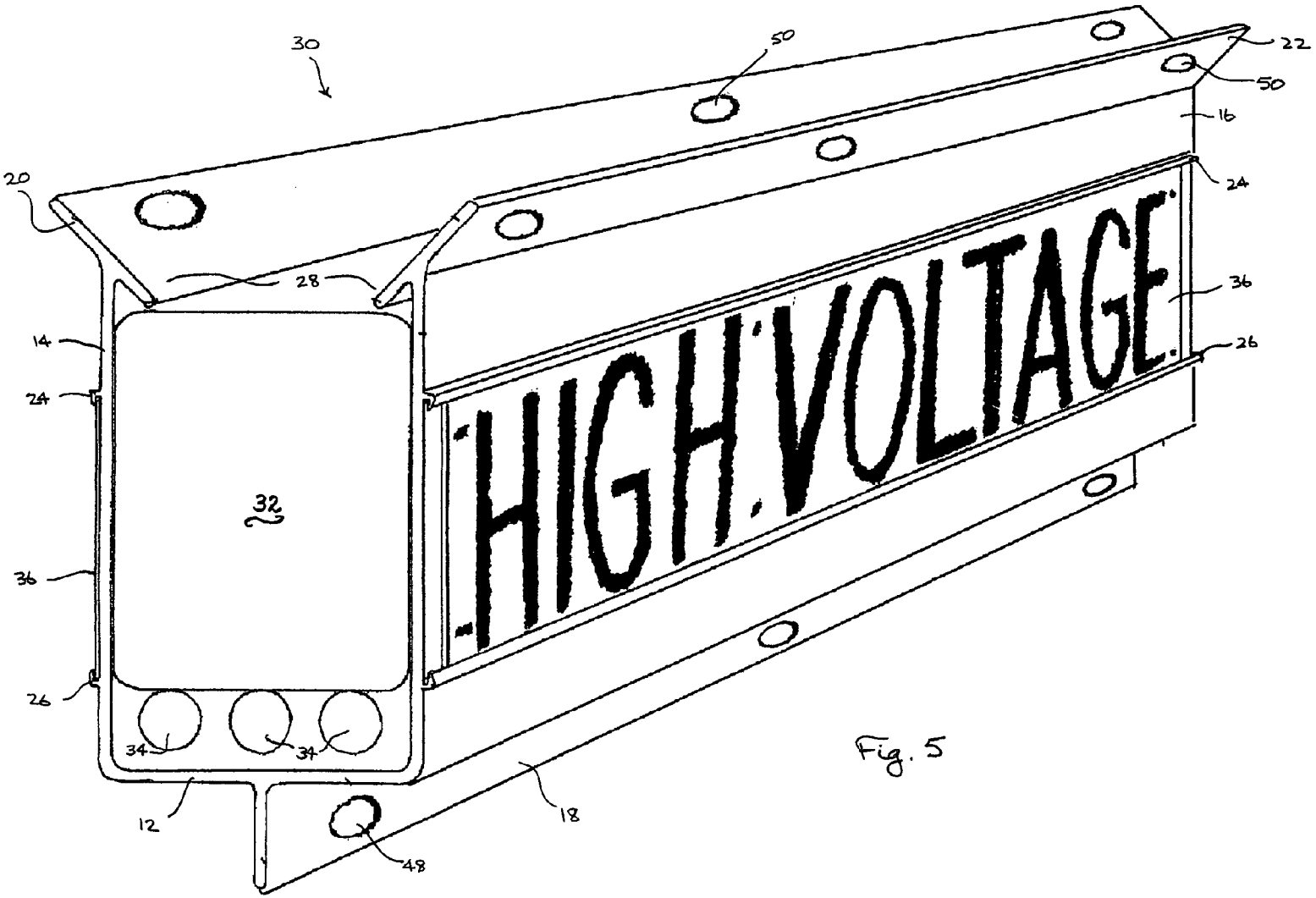
FIG. 5 is a perspective view of the utility pole warning sign disposed on a cross arm.

FIG. 5 is a perspective view of the utility pole warning sign disposed on a cross arm as shown in FIG. 2. Fin 18 has holes 48 to facilitate the handling of the utility pole warning sign 30 with a hot stick. Oblique members 20, 22 may also have holes 50 for this purpose.

Modifications to the above would be obvious to those of ordinary skill in the art, but would not bring the invention so modified beyond the scope of the appended claims.

What is claimed is:

1. A warning sign for mounting on a structural member, such as a cross arm of a utility pole, said warning sign comprising:

an elongated U-shaped support member, said support member having a base, a first side, a second side and an interior between said first and second sides; said base having a fin extending therefrom in a direction away from said first side and said second side, said fin being provided for grasping said support member; said first side and said second side each extending from said base to top ends having a first oblique member and a second oblique member, respectively; said first and second oblique members being inclined toward said interior, so that, when said support member is pushed against said structural member, said first and second sides separate to accommodate said structural member; said first and second oblique members each having an inner end extending inward of said first side and said second side, respectively, toward said interior, so that, when said support member completely covers said structural member, said inner ends extend over said structural member to prevent the removal of said support member from said structural member; and a warning message on at least one of said first and second sides.

2. A warning sign as claimed in claim 1 wherein said fin has at least one hole transversely therethrough to facilitate the grasping thereof.

3. A warning sign as claimed in claim 1 wherein said first and second sides of said support member are inclined toward one another.

4. A warning sign as claimed in claim 1 wherein said warning message is a coextruded sheet having two layers, each of said two layers being of a different color, said warning message having text engraved into one of said two layers to a depth exposing the other of said two layers.

5. A warning sign as claimed in claim 4 wherein said coextruded sheet is of a high-density polyethylene.

6. A warning sign as claimed in claim 5 wherein said high-density polyethylene includes ultraviolet inhibitors.

7. A warning sign as claimed in claim 4 wherein one layer is yellow in color and the other layer is black in color.

8. A warning sign as claimed in claim 1 wherein at least one of said first and second sides has an upper and a lower longitudinal slot member so that said warning message may be slidingly disposed therein.

9. A warning sign as claimed in claim 1 wherein said support member is extruded from a high-density polyethylene.

10. A warning sign as claimed in claim 9 wherein said high-density polyethylene includes ultraviolet inhibitors.

11. A warning sign as claimed in claim 1 wherein said first oblique member has at least one hole transversely therethrough to facilitate the grasping thereof.

12. A warning sign as claimed in claim 1 wherein said second oblique member has at least one hole transversely therethrough to facilitate the grasping thereof.

* * * * *